US007798597B2

(12) United States Patent
Chikamoto

(10) Patent No.: US 7,798,597 B2
(45) Date of Patent: Sep. 21, 2010

(54) INKJET RECORDING DEVICE

(75) Inventor: Tadanobu Chikamoto, Nakagawa-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 310 days.

(21) Appl. No.: 12/032,818

(22) Filed: Feb. 18, 2008

(65) Prior Publication Data

US 2008/0198196 A1 Aug. 21, 2008

(30) Foreign Application Priority Data

Feb. 16, 2007 (JP) ..... 2007-035764

(51) Int. Cl.
*B41J 2/14* (2006.01)
*B41J 2/165* (2006.01)

(52) U.S. Cl. ..... 347/20; 347/29

(58) Field of Classification Search ..... 347/20, 347/22, 29, 32
See application file for complete search history.

(56) References Cited

U.S. PATENT DOCUMENTS 6,866,361 B2 3/2005 Kuki et al.
2003/0058301 A1 3/2003 Sekiya
2006/0114286 A1 6/2006 Na

FOREIGN PATENT DOCUMENTS

| | | | |
|---|---|---|---|
| EP | 1439066 | A1 | 7/2004 |
| JP | H11-198406 | A | 7/1999 |
| JP | 2001-301185 | A | 10/2001 |
| JP | 2003-175617 | A | 6/2003 |
| JP | 2003-231267 | A | 8/2003 |
| JP | 2004142450 | A | 5/2004 |

OTHER PUBLICATIONS

European Patent Office, European Search Report for Related EP Application No. 08002844 dated Nov. 19, 2008.
Japanese Patent Office, Japanese Office Action issued in corresponding Japanese Application No. 2007-035764 mailed on Jan. 6, 2009.

*Primary Examiner*—Huan H Tran
(74) *Attorney, Agent, or Firm*—Baker Botts, LLP.

(57) ABSTRACT

An inkjet recording device of the present invention includes an inkjet head and a cap. The inkjet head includes a passage unit formed by a lamination of at least one plate and a nozzle plate. Amongst the plate and the nozzle plate, a plate positioned farther from the nozzle plate has a larger plane shape than a plate closer to the nozzle plate so that the passage unit has, around the entire circumference thereof, a stair-like shaped outer circumferential wall. When the cap covers a plurality of nozzles that the nozzle plate has, the circular protrusion abuts the outer circumferential wall of the passage unit so as to enclose the nozzle plate within the recessed portion.

8 Claims, 11 Drawing Sheets

INKJET RECORDING DEVICE

CROSS REFERENCE TO RELATED APPLICATION

The present application claims priority from Japanese Patent Application No. 2007-035764, which was filed on Feb. 16, 2007, the disclosure of which is herein incorporated by reference in its entirety.

BACKGROUND OF THE INVENTION

1. Field of the Invention

The present invention relates to an inkjet recording device including an inkjet head which ejects ink.

2. Description of Related Art

Japanese Unexamined Patent Publication No. 2004-142450 describes an inkjet recording device provided with a maintenance unit including a blade, a wipe roller, an ink receiving member, and a purge cap. In the maintenance unit of this inkjet recording device, a suction force is generated inside a nozzle after covering the nozzle surface with the purge cap, thereby sucking out dust, ink containing air-bubbles, thickened ink, or the like from the nozzle. The residual ink on the nozzle surface is then wiped off by means of the ink receiving member and the wipe roller.

SUMMARY OF THE INVENTION

The maintenance unit of the inkjet recording device described in the above publication remains stationary in a standby position while the inkjet head is not subjected to a maintenance. While the maintenance unit is thus positioned, a foreign substance floating in the air may adhere onto the purge cap. Since the purge cap abuts the nozzle surface during a maintenance, the foreign substance on the purge cap could be transferred onto the nozzle surface during the maintenance. This foreign substance having transferred on to the nozzle surface may become a core for an ink clot to grow therearound, consequently destabilizing the ink ejection from the nozzle. Further, when the foreign substance having been transferred from the purge cap to the nozzle surface is wiped off from the nozzle with an aid of the blade, the foreign substance may be dragged by the blade and may be pushed into the nozzle by the pressing force applied from the blade to the nozzle. This also destabilizes the ink ejection from the nozzle.

An object of the present invention is therefore to provide an inkjet recording device in which a foreign substance adhered onto a purge gap hardly adheres onto an ink ejection surface of the device.

From a first viewpoint of the present invention, an inkjet recording device includes an inkjet head and a cap. The inkjet head includes a passage unit formed by a lamination of at least one plate and a nozzle plate having a plurality of nozzles, and laminated so that the nozzle plate is positioned outermost of the lamination. The cap covers the plurality of nozzles, and includes a circular protrusion forming a recessed portion having an opening broader than the nozzle plate. Amongst the plate and the nozzle plate, a plate positioned farther from the nozzle plate has a larger plane shape than a plate closer to the nozzle plate so that the passage unit has, around the entire circumference thereof, a stair-like shaped outer circumferential wall. When the cap covers the plurality of nozzles, the circular protrusion abuts the outer circumferential wall of the passage unit so as to enclose the nozzle plate within the recessed portion. Thus, an inkjet recording device of the present invention is provided.

From a second viewpoint of the present invention, an inkjet recording device includes an inkjet head and a cap. The inkjet head includes a passage unit formed by a lamination of at least one plate and a nozzle plate having an ink ejection surface which a plurality of nozzles are positioned, and laminated so that the ink ejection surface of the nozzle plate is positioned outermost of the lamination. The cap covers the plurality of the nozzles, and includes a circular protrusion forming a recessed portion having an opening broader than the ink ejection surface. The nozzle plate has slanted portions each of which is continuous from the ink ejection surface, and which is tilted relative to the ink ejection surface so as to face the plate. When the cap covers the plurality of nozzles, the circular protrusion abuts the slanted portions. Thus, an inkjet recording device of the present invention is provided.

According to the first and second viewpoints, it is possible to form a sealed space covering the plurality of nozzles while preventing the circular protrusion of the cap from abutting the ink ejection surface. Thus, a foreign substance having adhered onto the circular protrusion is restrained from being transferred onto the ink ejection surface.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes preferred embodiments of the present invention with reference to the attached drawings.

Figure 1:
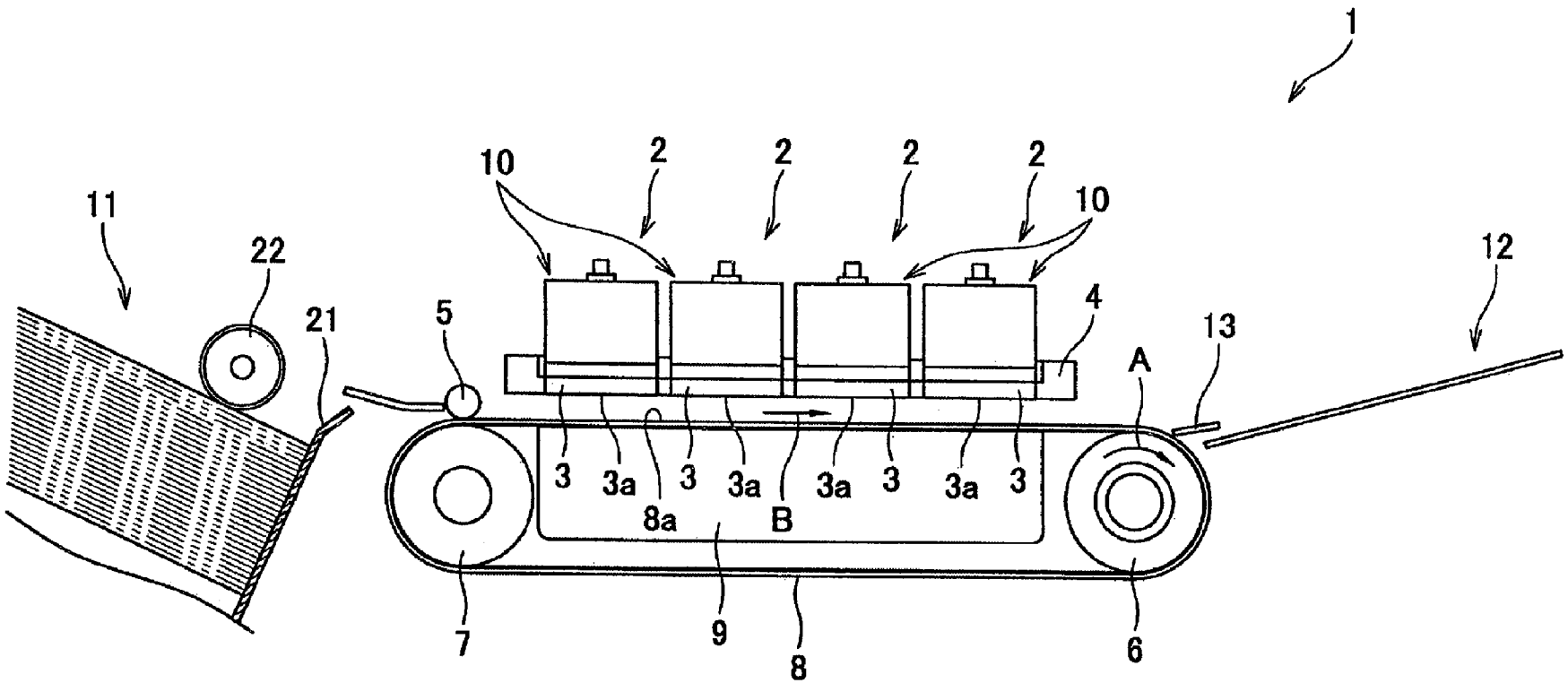
FIG. 1 is a cross sectional view schematizing a side of an inkjet printer of Embodiment 1, according to the present invention.
Figure 2:
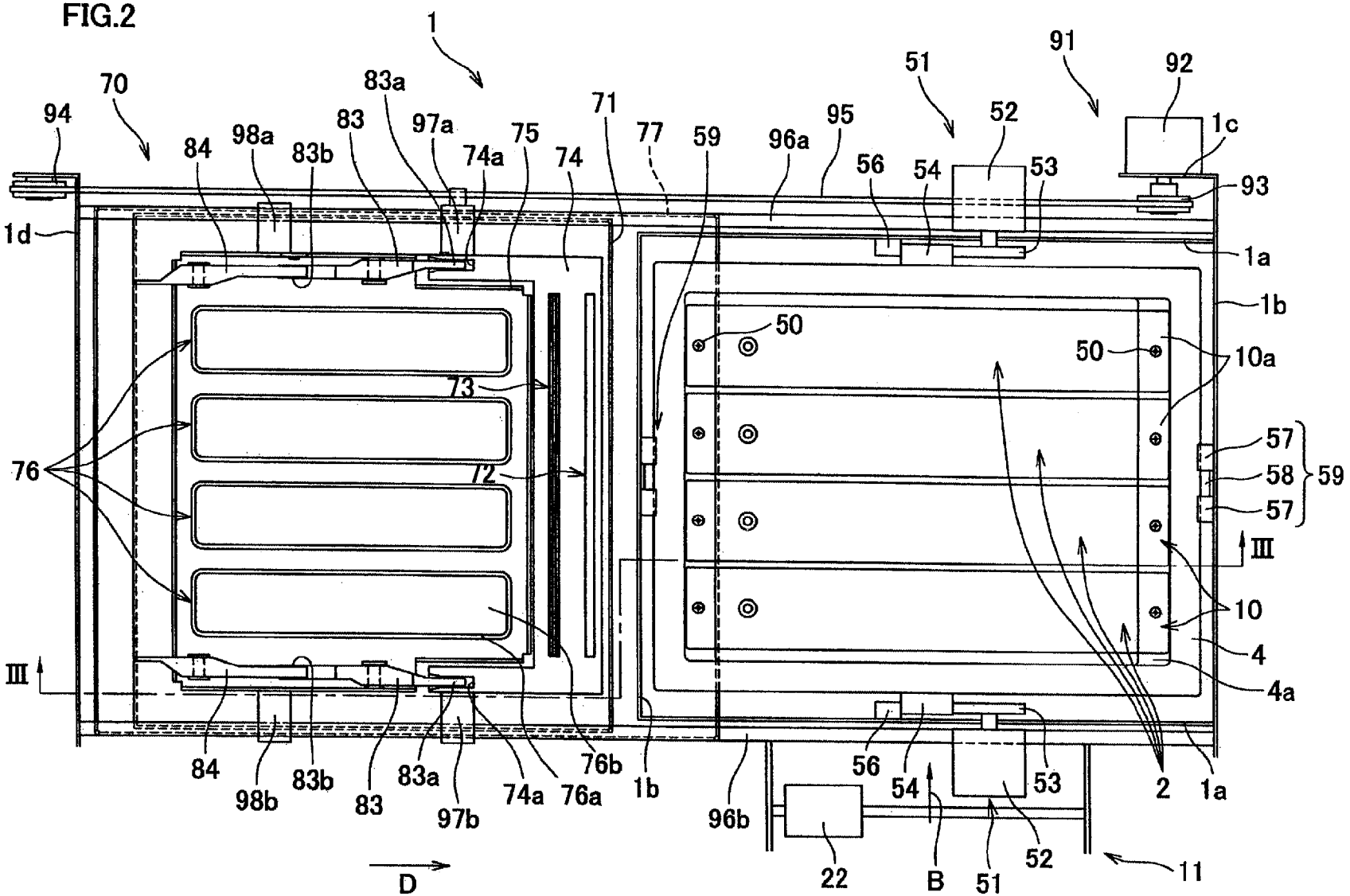
FIG. 2 is a plane view schematizing a main part of the inkjet printer of Embodiment 1, according to the present invention.
Figure 3:
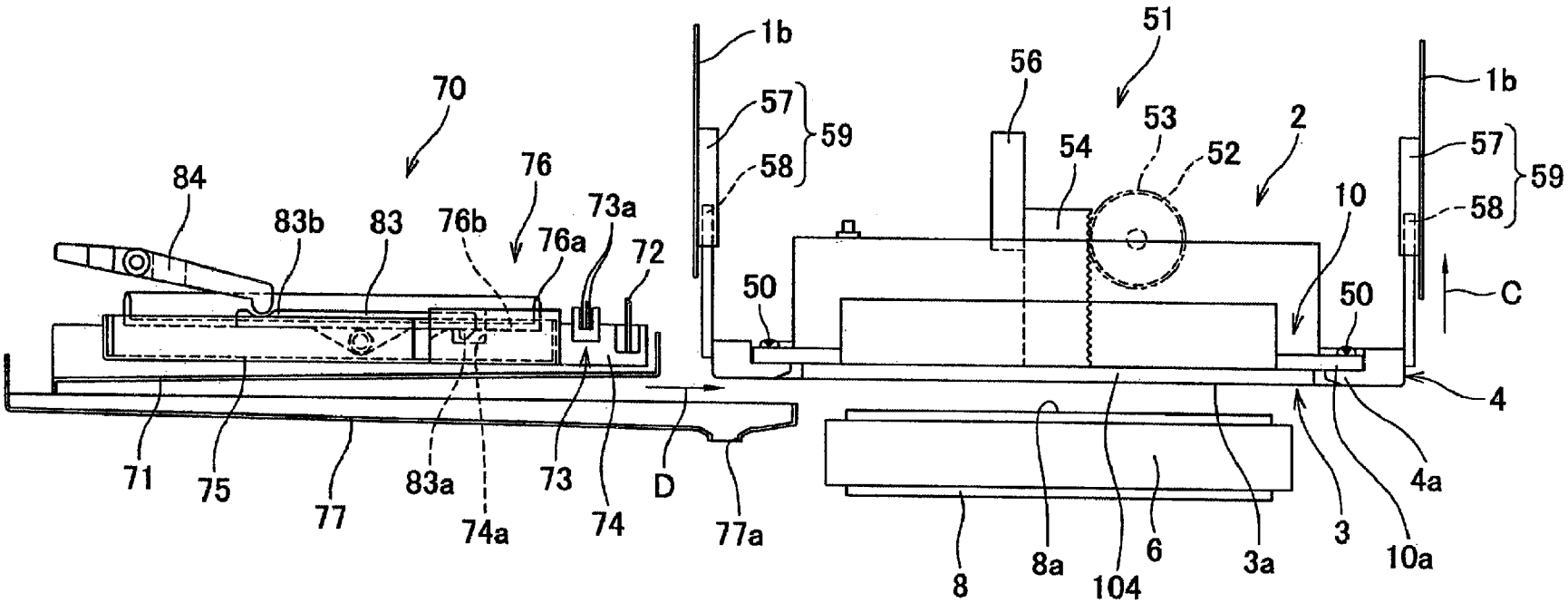
FIG. 3 is a cross sectional view taken along the line III-III of FIG. 2.

FIG. 1 is a cross sectional view schematizing a side of an inkjet printer of Embodiment 1, according to the present invention. FIG. 2 is a plane view schematizing a main part of the inkjet printer of Embodiment 1. FIG. 3 is a cross sectional view taken along the line III-III of FIG. 2.

As shown in FIG. 1, the inkjet printer 1 is a color inkjet printer including four inkjet heads 2. This inkjet printer 1 includes a paper feeding structure 11 which is disposed leftward in FIG. 1, and a paper delivering section 12 which is disposed rightward in FIG. 1.

Inside the inkjet printer 1, formed is a sheet transfer path through which a sheet which is a recording medium is transferred from the paper feeding structure 11 to the paper delivering section 12. The paper feeding structure 11 is provided with a pickup roller 22 by which a sheet on top of a plurality of sheets stored in the sheet tray 21 is fed. This pickup roller 22 feeds each sheet from the left to the right in FIG. 1. Further, two belt rollers 6 and 7, and an endless transfer belt 8 are disposed in an intermediate part of the sheet transfer path. The endless transfer belt is wound about the both rollers 6 and 7 so as to bridge the both rollers 6 and 7.

The outer circumferential surface of the transfer belt 8, i.e., transfer surface 8*a*, has been subjected to a silicone treatment so as to have an adherence on the surface. On the position which is slightly distant relative to the sheet transfer direction from the paper feeding structure 11, a pressing roller 5 is positioned so as to oppose the transfer belt 5. The pressing roller 5 presses each sheet fed from the paper feeding structure 11 against the transfer surface 8*a* of the transfer belt 8. That way, the sheet pressed against the transfer surface 8*a* is retained by the adherence of the transfer surface 8*a*, while being transferred in the sheet transfer direction. At this point, the belt roller 6 which is disposed near the paper delivering section 12 than belt roller 7 is given a driving force from a not-shown driving motor, and is rotated in the clockwise direction, i.e., in the direction of arrow A, in FIG. 1.

A peeling member 13 is provided between the transfer belt 8 and the paper delivering section 12. The peeling member 13 peels a sheet retained on the transfer surface 8*a* of the transfer belt 8, and feeds the sheet to the paper delivering section 12.

Inside a region surrounded by the transfer belt 8, a substantially rectangular parallelepiped platen 9 is disposed. The platen 9 supports the transfer belt 8 from the inner circumferential surface, by contacting a portion of the transfer belt 8 opposing the inkjet heads 2: i.e., upward the under surface of the transfer belt 8. As shown in FIG. 1, the platen 9 ensures a predetermined space between the top surface of the transfer belt 8 and the under surface of the inkjet head 2.

The four inkjet heads 2 respectively correspond to ink of four colors: magenta, yellow, cyan and black. These four inkjet heads are aligned along a sheet transfer direction B which extends from the lower to the upper of FIG. 2. In short this inkjet printer 1 is a line printer.

The four inkjet heads 2 are disposed adjacent to each other along the sheet transfer direction B, and are fixed on a frame 4. As shown in FIGS. 2 and 3, the frame 4 has a support member 4*a* which projects so as to face the lower surfaces of both ends of a later-described reservoir units 10 in the length direction. The support member 4*a* and the both ends of the later-described reservoir units 10 are fixed by using screws 50. Thus, four inkjet heads 2 are surrounded by the frame 4 and are fixed thereon. Further, as shown in FIG. 3, respective ink ejecting surfaces 3*a* on the lower surfaces of the inkjet heads 2 are exposed from an opening of the frame 4, and are substantially flush with the under surface of the support member 4*a* of the frame 4.

Further, the frame 4 is supported by frame moving structures 51 of the inkjet printer 1, in such a manner that the frame 4 is moveable in the up/down direction. As shown in FIG. 2, the frame moving structures 51 are provided on both ends, i.e., top and bottom of FIG. 2, of the frame 4, in the sheet transfer direction B. The frame moving structures 51 each include: a drive motor 52 serving as a drive source for moving the frame 4 up and down; a pinion gear 53 fixed on an axis of the drive motor 52, a rack gear 54 disposed upright to the frame 4 so as to be engaged with the rack gear 54; and a guide 56 positioned so that the rack gear 54 is interposed between the guide 56 and the rack gear 54.

Two drive motors 52 are respectively fixed on main body frames 1*a* of the inkjet printer 1 which frames are aligned in the sheet transfer direction B so as to face each other. The two rack gears 54 are extended in an up/down direction, and the lower ends of the rack gears 54 are fixed on the side surfaces of the frame 4 respectively. Further, a side surface of each rack gear 54 opposite to the pinion gear 53 are in contact with the guide 56 in a slidable manner. The both guides 56 are fixed on the main body frames 1*a* respectively.

In this structure, the rack gears 54 move upward or downward when the pinion gears 53 are rotated in the positive direction or the negative direction by rotating the two drive motors 52 in synchronization with each other. Along with the upward or downward movement of the rack gears 54, the frame 4 and the four inkjet heads 2 also move upward or downward.

Further, guide sections 59 are respectively disposed on both ends of the frame 4 in the length direction of the inkjet heads 2. The guide sections 59 each include: a rod-like member 58 and a pair of guides 57 which interpose therebetween the rod-like member 58. Of these members, the pair of guides 57 are extended in the up/down direction as shown in FIG. 3. These guides 57 are fixed on main body frames 1*b* aligned so as to face each other, in a direction perpendicular to the sheet transfer direction B. On the other hand, the rod-like member 58 is extended in the up/down direction as is the case of the guides 57, but the rod-like member 58 is fixed on a side surface of the frame 4 which is in parallel to the main body frame 1*b* and which faces the frame 4. Further, the rod-like member 58 is interposed between the pair of guides 57 in a slidable manner.

With the guide section 59, it is possible to prevent the ink ejecting surfaces 3*a* of the inkjet heads 2 from tilting relative to the transfer surface 8*a*, when the frame moving structure 51 moves the frame 4 upward or downward. In short the ink ejecting surfaces 3*a* are always parallel to the transfer surface 8*a* on the other side, irrespective of the upward or downward movement of the frame 4 and inkjet heads 2 caused by the frame moving structure 51. This improves the accuracy of landing ink on the sheet at the time of printing.

As shown in FIG. 3, the inkjet heads 2 have at their lower ends head main bodies 3, respectively. On the top surface of each of the head main bodies 3, fixed is a reservoir unit 10 which supplies ink to the head main body 3. As shown in FIGS. 2 and 3, the reservoir unit 10 has a head fixture 10*a* which is longer than the head main body 3 in the direction perpendicular to the sheet transfer direction B. The head fixture 10*a* is extended in the length direction of the head main body 3, and is fixed on the support member 4*a* of the frame 4.

As shown in FIG. 3, the frame 4 is usually disposed in a printing position where the four inkjet heads 2 perform printing operation by ejecting ink. Only during the maintenance period of the inkjet heads 2, the frame 4 is moved by the frame moving structure 51 in the direction shown by the arrow C in FIG. 3, so as to dispose the four inkjet heads 2 in a head maintenance position which is above the printing position. Note that, in the present embodiment, the maintenance period can be: a purge operation period during which ink is forcedly ejected from the inkjet heads 2; a wiping operation period during which ink adhered on the ink ejecting surfaces 3*a* is wiped off; and a capping operation period during which each of the ink ejecting surfaces 3*a* is covered with a later-described cap 76.

In the printing operation, the frame moving structure 51 moves the frame 4 downwards so as to create a slight space between the ink ejecting surfaces 3*a*, i.e., under surface of the head main bodies 3, and the transfer surface 8*a* of the transfer belt 8. This space is a part of the sheet transfer path. With this structure, when a sheet is transferred by the transfer belt 8 and successively passes immediately under the four head main bodies 3, ink droplets of the respective colors are ejected from nozzles 108 towards the top surface of the sheet, thereby forming an intended color image on the sheet.

Figure 4:
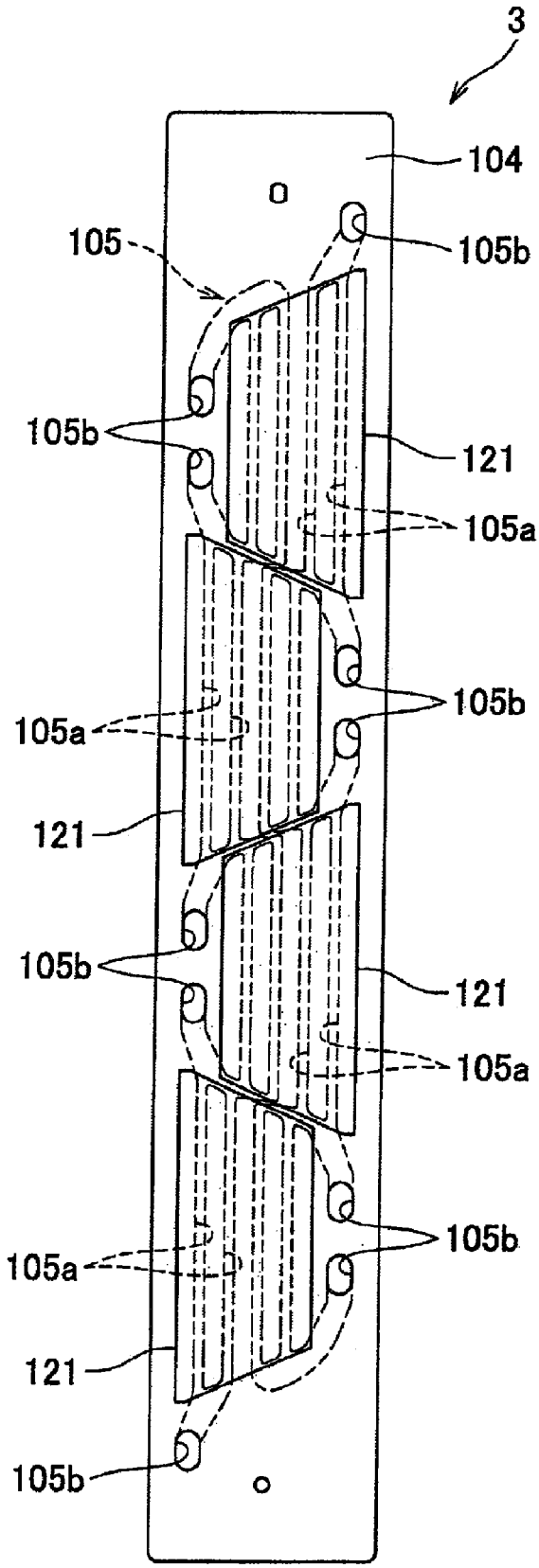
FIG. 4 is a plane view showing the main body of a head shown in FIG. 1.
Figure 5:
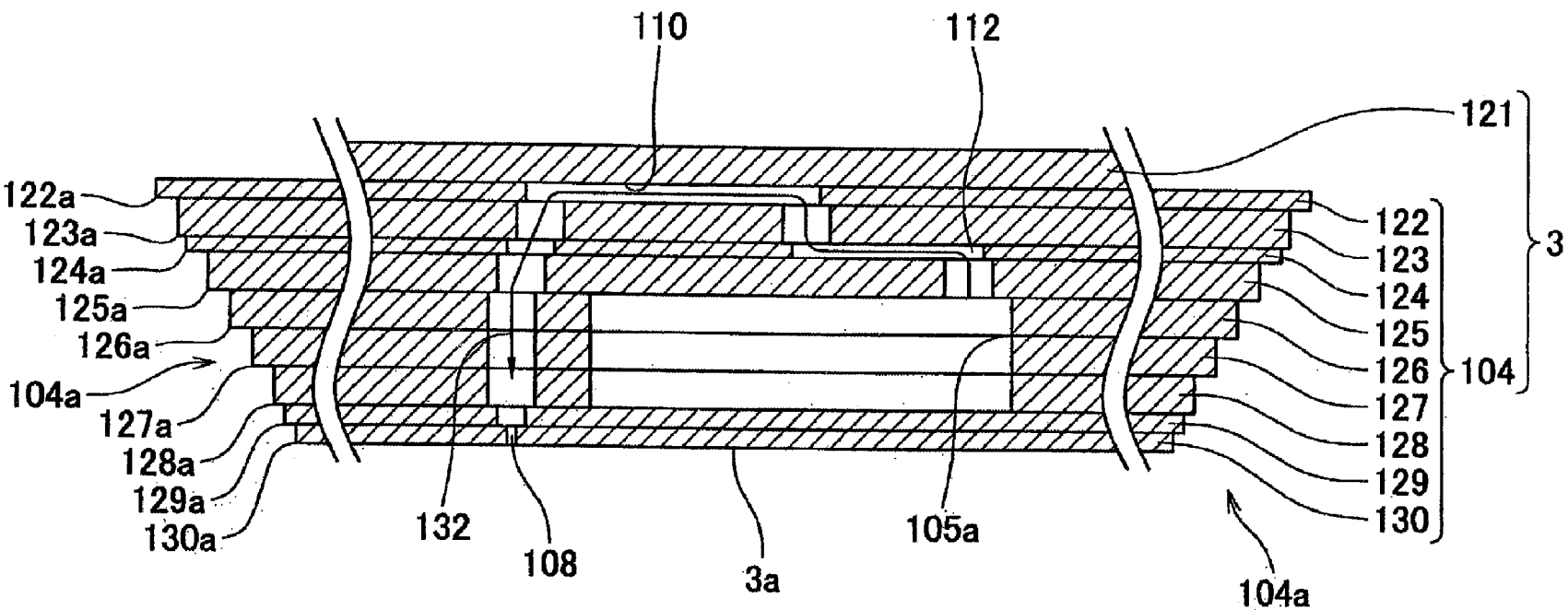
FIG. 5 is a cross sectional view showing a part of the head main body shown in FIG. 4.

Next described in detail with reference to FIGS. 4 and 5 is the head main bodies 3. FIG. 4 is a plane view of one of the head main bodies 3 shown in FIG. 1. FIG. 5 is a cross sectional view showing a part of the head main body 3. As shown in FIGS. 4 and 5, the head main body 3 includes: a passage unit 104 having a rectangular shape in a plane view; and four trapezoidal actuator units 121 disposed in zigzag on the top surface of the passage unit 104.

A part of the under surface of the passage unit 104 which corresponds to the actuator units 121 is an ink ejection region having a plurality of nozzles 108. On the top surface of the passage unit 104, a plurality of pressure chambers 110 are formed. The pressure chambers 110 are respectively linking to the nozzles 108. Each of the actuator units 121 is arranged so as to cover a plurality of the pressure chambers 110. Further, the passage unit 104 includes therein: a manifold passage 105 which stores therein ink to be supplied to the pressure chambers 105; and sub manifold passages 105*a* branching off from the manifold passage 105. As shown in FIG. 5, an individual ink passage 132 is formed so as to extend from each of the sub manifold passages 105*a* to each of the nozzles 108 via each of the pressure chambers 110.

The ink from the reservoir unit 10 is supplied to the manifold passage 105 via an opening 105*b* formed on the top surface of the passage unit 104, and is distributed to the pressure chambers 110. Then, when the actuator units 121 selectively applies a pressure to at least one of the pressure chambers 110, the pressure of the ink inside the pressurized pressure chamber 110 is increased and the ink is ejected from at least one of the nozzles 108 which links to the pressurized pressure chamber 110.

As shown in FIG. 5, the passage unit 104 has a laminated structure in which a cavity plate 122, a base plate 123, an aperture plate 124, a supply plate 125, manifold plates 126-128, a cover plate 129 and a nozzle plate 130 are laminated from the top in this order.

The above described nine plates are all metal plates. The cavity plate 122 has thereon a plurality of holes to become the pressure chambers 110. The aperture plate 124 has thereon a plurality of holes to become apertures 112 which function as throttles respectively corresponding to the pressure chambers 110. Each of the manifold plates 126 to 128 has thereon a hole to become the sub manifold passage 105. The nozzle plate 130 has thereon a plurality of nozzles 108. The under surface of the nozzle plate 130 is the ink ejecting surface 3*a*. Further, the base plate 123 is provided with a plurality of linking holes for respectively linking the pressure chambers 110 to the apertures 112. The supply plate 125 is provided with a plurality of linking holes for respectively linking the apertures 112 to the sub manifold passages 105*a*. Each of the plates 123 to 129 is provided with a plurality of linking holes for respectively linking the corresponding pressure chambers 110 to the nozzles 108. These nine plates 122 to 130 are positioned and laminated so as to form the individual ink passage 132.

Further, each of the nine plates 122 to 130 have a plane rectangular shape. The respective planer dimensions of the plates 122 to 130 are gradually increased so that, amongst those plates, a plate farther from the nozzle plate 130 has a larger planer dimension than a plate closer to the nozzle plate 130. Furthermore, these nine plates 122 to 130 are laminated so as to form a stair-like shaped outer circumferential wall 104*a* of the passage unit 104. The outer circumferential wall 104*a* therefore has a plurality of edges which are formed by the respective under surfaces of the plates 122 to 130, i.e., the surfaces facing the nozzle plate 130, and the respective side surfaces of the plates 122 to 130.

In the present embodiment, two edges 128*a* and 129*a* amongst edges 122*a* to 130*a* are portions which abut the later-described cap 76, and are apart from each other in a direction away from the nozzle plate 130 at a certain angle. Similarly, the rest of the edges, i.e., edges 122*a* and 123*a*; edges 123*a* and 124*a*; edges 124*a* and 125*a*; edges 125*a* and 126*a*; edges 126*a* and 127*a*; edges 127*a* and 128*a*; and edges 129*a* and 130*a*, are apart from each other in the direction away from the nozzle plate 130.

Next described is the maintenance unit 70 for performing maintenance with respect to the inkjet heads 2. As shown in FIGS. 2 and 3, the inkjet printer 1 is provided with the maintenance unit 70 for performing maintenance with respect to the inkjet heads 2 on the left of the inkjet heads 2. Further, as shown in FIG. 3, the maintenance unit 70 includes trays 71 and 75 which are horizontally moveable.

Of these trays, the tray 71 has a square box-like shape opened upwardly, as shown in FIGS. 2 and 3, and is configured so as to store therein the tray 75. The trays 71 and 75 are made attachable/detachable to/from each other by respectively engaging/disengaging later-described recessed portions 74*a* with hooking portions 83*a*. The trays 71 and 75 are attached or detached, according to the type of maintenance performed.

As shown in FIG. 3, the side of the tray 71 opposite to the inkjet head 2 is opened. The tray 71 therefore is able to horizontally move toward the inkjet head 2 while leaving the tray 75 at its original position, when the tray 71 is disengaged from the tray 75 in an occasion of a later-described purge operation for example. Further, whether or not the later-described recessed portions 74*a* and hooking portions 83*a* are respectively engaged with each other, the frame 4 is moved upward, i.e., in the direction shown by the arrow C in FIG. 3, to the head maintenance position prior to a later-described horizontal movement of the maintenance unit 70, thereby ensuring a space, for the maintenance unit 70, between the four ink ejecting surfaces and the transfer surface 8*a*. After that, the maintenance unit 70 is horizontally moved in the direction shown by the arrow D in FIG. 3.

Further, immediately below the maintenance unit 70, a waste-ink receiving tray 77 is arranged. In a plane view, this waste-ink receiving tray 77 has a size which encloses therein the tray 71. The shape of the waste-ink receiving tray 77 is such that portions of the tray 71 nearby the side surfaces thereof respectively overlap the waste-ink receiving tray 77 even when the tray 71 is moved to the right end in FIG. 2. In the end portion of the waste-ink receiving tray 77 that is near the inkjet heads 2, there is provided an ink discharging hole 77*a* which penetrates the tray 77 in the up/down direction. The ink discharging hole 77*a* passes the ink having flown into the waste-ink receiving tray 77 to a not-shown waste-ink storage.

The tray 71 sequentially includes, from the end portion of the tray 71 that is near the inkjet heads 2, a wiper 72, an ink receiving member 73, and a tray 75. These members are arranged along the sheet transfer direction B. As shown in FIG. 2, the tray 75 is provided with four caps 76 each having a rectangular shape in a plane view. These four caps 76 are aligned in the tray 75 so as to respectively correspond to the inkjet heads 2. More specifically, the four caps 76 are disposed in the sheet transfer direction B at the same pitch as the inkjet heads 2, and are directed so that the respective lengths of the caps 76 are parallel to those of the inkjet heads 2.

As shown in FIG. 2, the caps 76 each have: a plate-like member 76*b* which is one size larger than the nozzle plate 130, and whose shape is rectangular plane; and a circular protrusion 76*a* protruding upward from the periphery of the plate-like member 76*b*. The circular protrusion 76*a* is made of an elastic material such as rubber. The circular protrusion 76*a* is formed in a shape and a size so that, when the plate-like member 76*b* faces the entire ink ejecting surface 3*a*, the circular protrusion 76*a* is able to face the outer circumferential wall 104*a* of the passage unit 104. Further, the circular protrusion 76*a* forms a recessed portion 78 which is an opening broader than the nozzle plate 130. When the circular protrusion 76*a* abuts the outer circumferential wall 104*a*, the cap 76 creates a shielded space while enclosing the nozzle plate 103 in the recessed portion 78. The cap 76 therefore is able to cover the entire ink ejecting surface 3*a*. Further, each cap 76 is urged upward by two springs 88 (See FIGS. 7A and 7B), while being supported by the bottom surface of the tray 75.

As shown in FIG. 2, a retaining member 74 is fixed on the end portion of the tray 71 that is near the inkjet heads 2. This retaining member 74 retains the wiper 72 and the ink receiving member 73. As shown in the figure, the retaining member 74 has a horseshoe-like planer shape. In a portion of the retaining member 74 which portion extends in the sheet transfer direction B, the wiper 72 and the ink receiving member 73 are retained. Meanwhile, in two portions at the both ends of the retaining member 74 which portions extend in a direction perpendicular to the sheet transfer direction B, the recessed portions 74*a* are respectively formed.

As shown in FIGS. 2 and 3, the ink receiving member 73 has a plurality of thin plates 73*a* each of which is slightly longer than the total width of the four inkjet heads 2 aligned in parallel. The thin plates 73*a* are arranged in parallel to one another at an interval so as to generate a capillary force for absorbing ink. These thin plates 73*a* are all made of stainless.

Similarly to the thin plates 73*a*, the wiper 72 is also slightly longer than the total width of the four inkjet heads 2 aligned in parallel, and is arranged so that the length direction of the wiper 72 is parallel to the sheet transfer direction B. This wiper 72 is made of an elastic material such as rubber.

The trays 71 and 75 are made attachable/detachable by means of the recessed portions 74*a* and the hooking members 83. As shown in FIG. 2, the recessed portions 74*a* and hooking members 83 are provided nearby upper and lower edges of the trays 71 and 75 in the figure. Each of the hooking members 83 is extended in a direction perpendicular to the sheet transfer direction B, and is rotatably supported at its center point in the length direction on the side wall of the tray 75. Further, each hooking member 83 has a hooking portion 83*a* at its end portion that is near to the inkjet heads 2. When the hooking member 83 rotates clockwise in FIG. 3, the hooking portion 83*a* engages to the recessed portion 74*a*. Above the maintenance unit 70, the abutting members 84 are arranged so as to respectively correspond to the two hooking members 83.

An end portion of each of the abutting members 84 that is near the inkjet heads 2 could be: positioned to abut an end portion 83*b* of the hooking member 83 that is far from the inkjet heads 2, thereby pressing down the end portion 83*b*; or positioned apart from the end portion 83*b*. When these abutting members 84 abut the end portions 83*b*, the hooking portions 83*a* are disengaged from the recess portions 74*a*. On the other hand, when the abutting members 84 are apart from the end portions 83*b*, the hooking portions 83*a* are engaged to the recessed portion 74*a*, thus returning to the state as shown in FIG. 3.

When the later-described maintenance is not performed, the maintenance unit 70 is in a "standby position" as shown in FIG. 3, and the maintenance unit 70 therefore does not face the inkjet heads 2. When the maintenance is performed, the maintenance unit 70 horizontally moves from the standby position to the "maintenance position", and faces the ink ejecting surface 3*a* of the inkjet heads 2. At this point, the inkjet heads 2 are in a head maintenance position which is above the printing position. More specifically, the inkjet heads 2 are in an isolation position where the leading edge of the wiper 72 or that of each cap 76 do not abut the ink ejecting surface 3*a*.

Here, even during the maintenance, when the maintenance is a purge operation, it is only the tray 71 which moves from the standby position to the maintenance position, and the tray 75 is left in the standby position. The tray 71 then receives the wasted ink. When each of the ink ejecting surface 3*a* is to be covered by the cap 76, the trays 71 and 75 are engaged to each other by means of the recessed portions 74*a* and the hooking portions 83*a*, and are moved to a position where each of the caps 76 faces the corresponding ink ejecting surface 3*a*.

As shown in FIG. 2, each of the trays 71 and 75 are moveably supported by a pair of guide axes 96*a* and 96*b* each extended in a direction perpendicular to the sheet transfer direction B. The tray 71 is provided with two bearing sections 97*a* and 97*b*, and are projecting from both side surfaces of the retaining member 74 which are shown in the upper and lower sides of FIG. 2. The tray 75 is provided with two bearing sections 98*a* and 98*b*, and is projected from the both side surfaces of the tray 75 on the upper and lower sides of FIG. 2. Further, the pair of the guide axes 96*a* and 96*b* are respectively fixed by both ends thereof on main body frames 1*b* and 1*d*, and are arranged in parallel to both of the frames 1*b* and 1*d*. With this structure, the tray 71 and 75 moves along these guide axes 96*a* and 96*b*, in the right and left directions in FIG. 2.

Here, the following describes the horizontal movement structure 91 which moves the trays 71 and 75 in a horizontal direction. As shown in FIG. 2, the horizontal movement structure 91 includes: a tray motor 92; a motor pulley 93; an idle pulley 94; a timing belt 95; and guide axes 96*a* and 96*b*. The tray motor 92 is fixed by using a screw or the like on an attachment part 1*c* formed on an end portion of the main body frame 1*b* extended in sheet transfer direction B. The motor pulley 93 is connected to the tray motor 92, and is rotated as the tray motor 92 is driven. The idle pulley 94 is rotatably supported by the main body frame 1*d* which is the leftmost frame in FIG. 2. The timing belt 95 is arranged in parallel to the guide axis 96*a*, and is wound so as to bridge the motor pulley 93 and the idle pulley 94 paired with the motor pulley 93. Further, the timing belt 95 is connected to the bearing section 97*a* which is provided to the retaining member 74.

In this structure, when the tray motor 92 is driven, the motor pulley 93 rotates in the positive direction or in the negative direction, thereby moving the timing belt 95 along with the rotation. With the movement of timing belt 95, the tray 71 connected to the timing belt 95 via the bearing section 97*a* is moved towards the left or the right of FIG. 2: i.e., moved towards the standby position or the maintenance position. Note that, while the recessed portions 74*a* of the retaining member 74 are engaged to the hooking portions 83*a*, the wiper 72 and ink receiving member 73 in the tray 71 and the caps 76 in the tray 75 are moved together towards the maintenance position or to the standby position. On the other hand, while the hooking portions 83*a* are apart from the recessed portion 74*a*, the wiper 72 and the ink receiving member 73 in the tray 71 move to the maintenance position or the standby position.

Figure 6A:
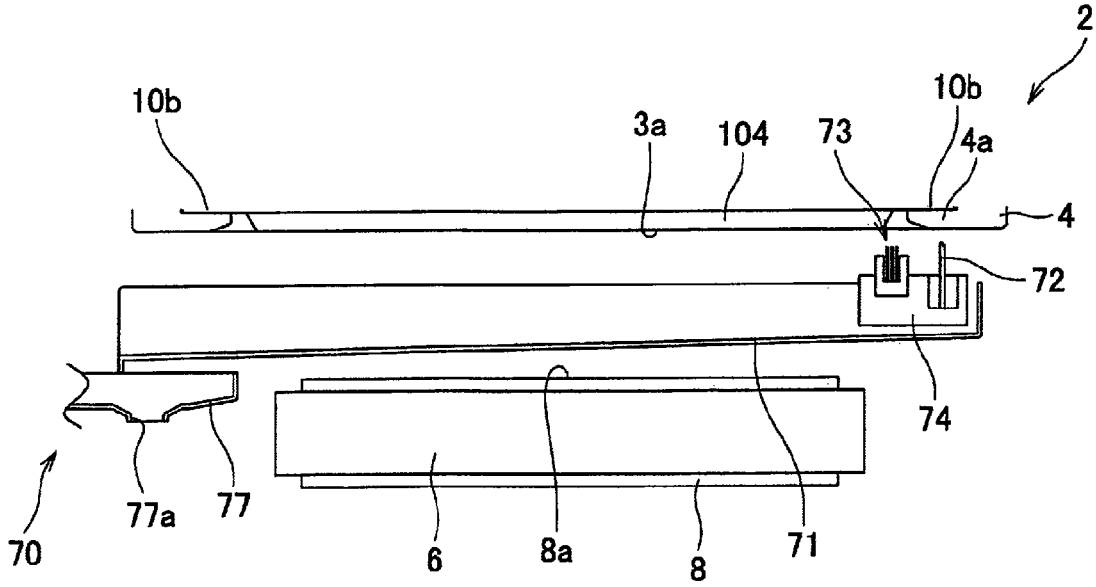
FIG. 6A is a diagram showing a positional relationship of the inkjet head and a maintenance unit shown in FIG. 3, when a purge operation is performed.
Figure 6B:
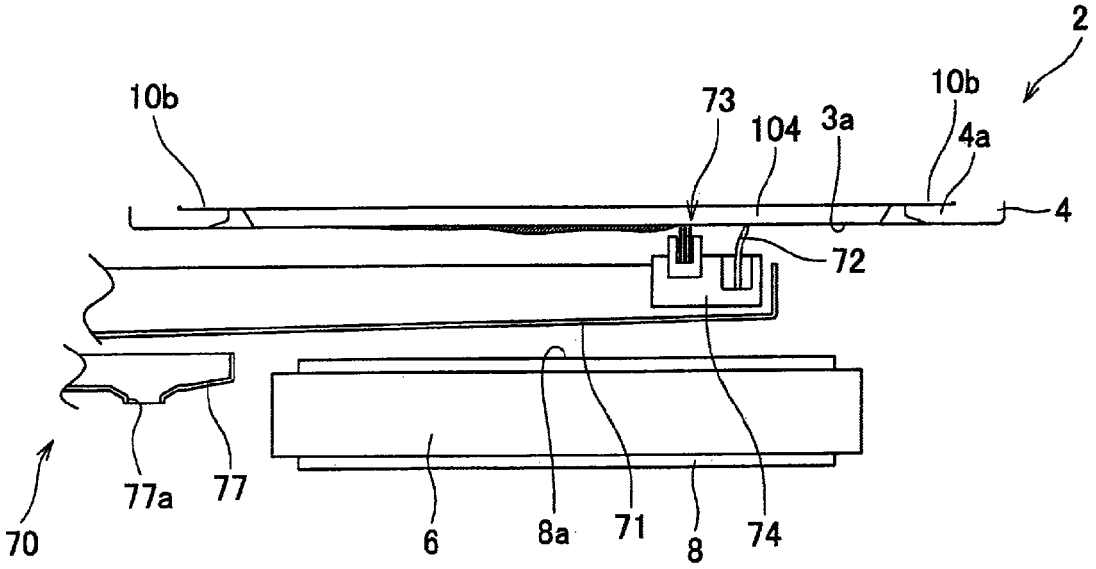
FIG. 6B is a diagram showing a positional relationship of the inkjet head and the maintenance unit shown in FIG. 3, when a wiping operation is performed.
Figure 7A:
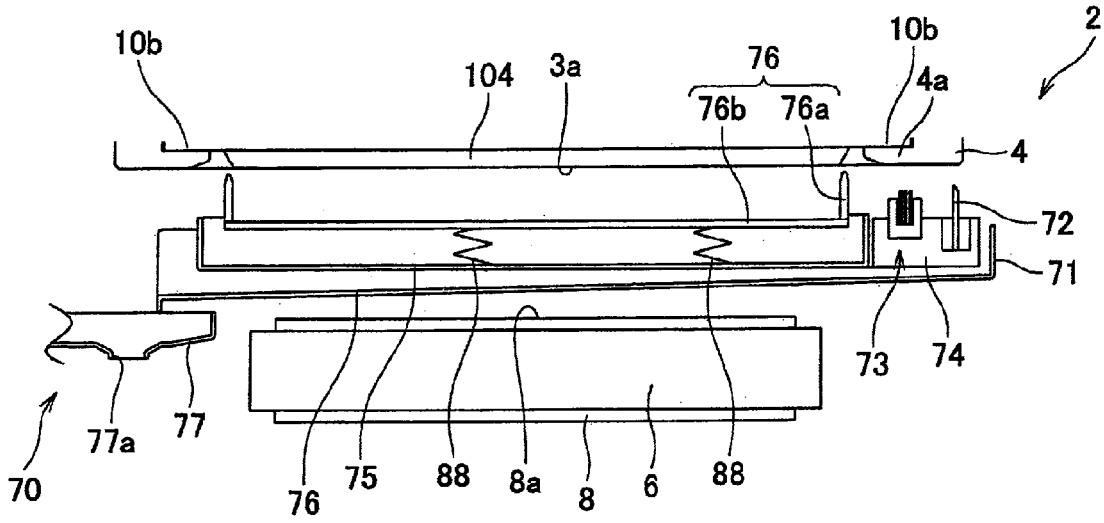
FIG. 7A is a diagram showing a situation where the entire maintenance unit is moved to a maintenance position.
Figure 7B:
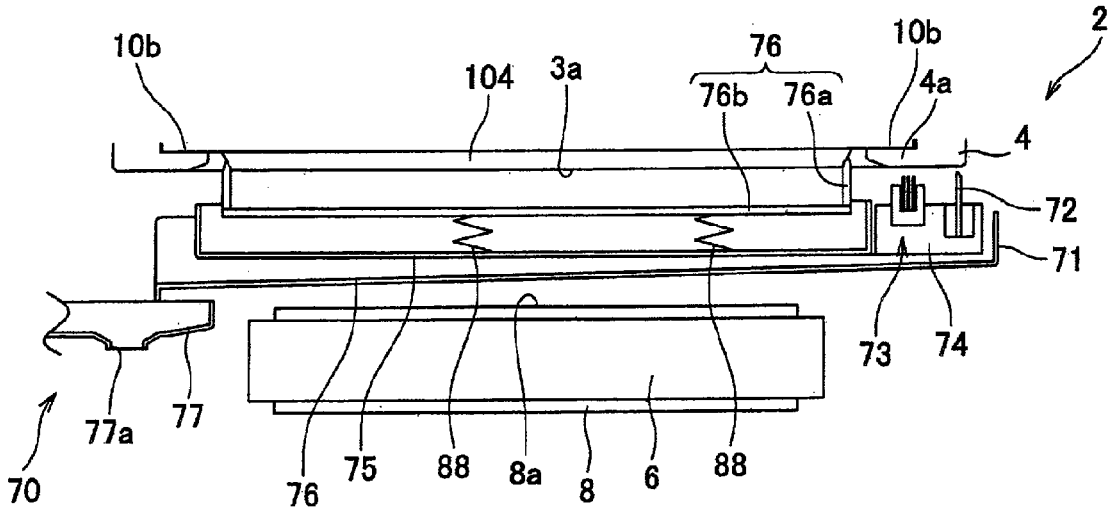
FIG. 7B is a diagram showing a situation where a circular protrusion of a cap abuts the outer circumferential wall of a passage unit.
Figure 8:
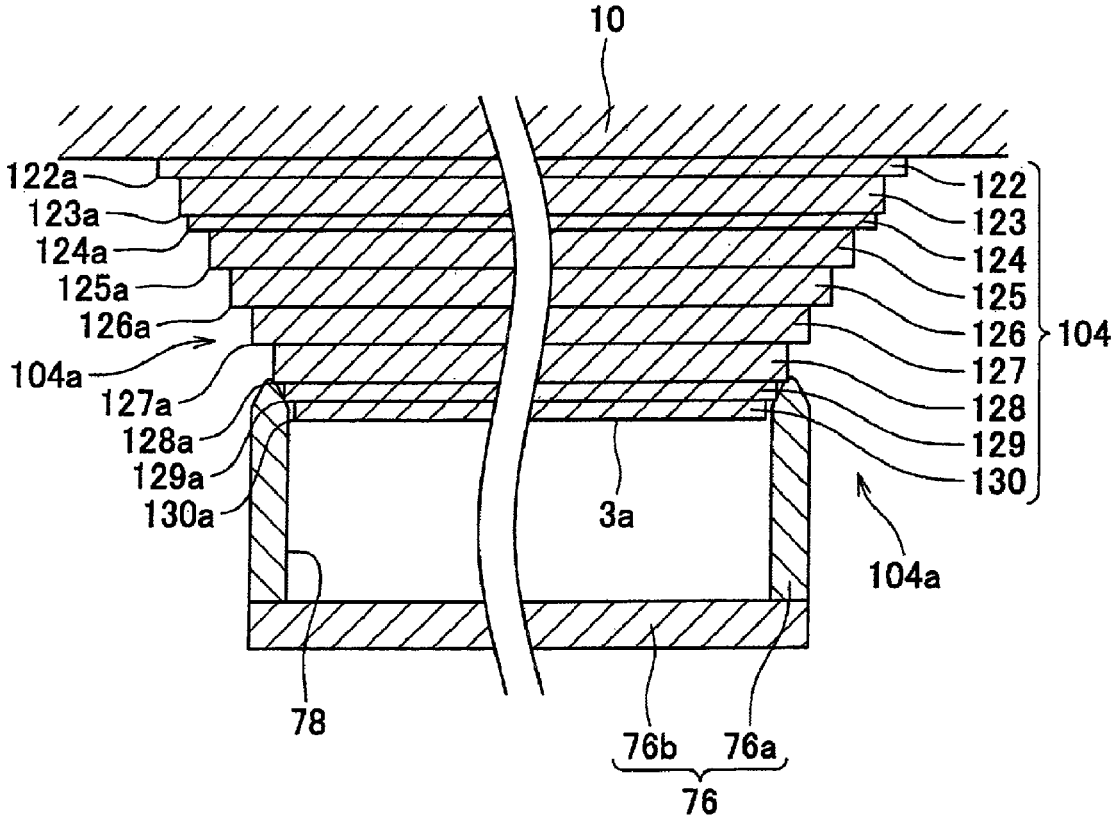
FIG. 8 is an enlarged partial detail of the passage unit and the cap shown in FIG. 7B.

Next described with reference to FIGS. 6A to 8 is an operation of the maintenance unit 70. FIG. 6A is a diagram showing a positional relationship of the inkjet heads 2 and the maintenance unit 70 during a purge operation. FIG. 6B is a diagram showing a positional relationship of the inkjet heads 2 and the maintenance unit 70 during a wiping operation. FIG. 7A is a diagram showing a situation where the entire maintenance unit 70 has moved to the maintenance position. FIG. 7B is a diagram showing a situation where the circular protrusion 76*a* of each cap 76 abuts the outer circumferential wall 104*a* of the corresponding passage unit 104. FIG. 8 is an enlarged partial detail of the passage unit 104 and the cap 76 shown in FIG. 7B.

When the purge operation is performed for recovering the inkjet heads 2 having a problem in ejecting ink, the frame 4 is moved upward by the frame moving structure 51. At this point, the two drive motors 52 are driven in synchronization with each other, so as to rotate the pinion gears 53 in the positive direction, i.e., clockwise direction in FIG. 3. Doing so will cause the rack gears 54 to rise with the rotation of the pinion gears 53. The frame 4 fixed onto the rack gears 54 also rises along with the four inkjet heads 2. The rotations of the drive motors 52 stops when the frame 4 and the inkjet heads 2 reach the isolation position.

That way, a space for disposing therein the maintenance unit 70 is formed between the ink ejecting surface 3*a* and the transfer belt 8. Thus, the bottom surface of the ink ejecting surface 3*a* of each inkjet head 2 and the bottom surface of the frame 4 in the isolation position do not interfere the leading edge of the corresponding circular protrusion 76*a* and the wiper 72, when the maintenance unit 70 is moved to the maintenance position.

Next, the abutting members 84 abuts the end portions 83*b* of the hooking members 83, so as to separate the hooking portions 83*a* from the recessed portions 74*a*, thereby disengaging the recessed portions 74*a* from the hooking portions 83*a*. In short, the trays 71 and 75 are disengaged from each other. During this state, the tray motor 92 of the horizontal movement structure 91 is driven to move the timing belt 95 so as to move the tray 71 to the maintenance position. Then, as shown in FIG. 6A, the driving of the tray motor 92 stops when the tray 71 reaches the maintenance position.

Next, a purge operation is performed as follows. A not-shown pomp is driven to forcedly feed ink inside a not-shown ink tank to the inkjet heads 2. Then, from the nozzles 108 of the inkjet head 2, the ink is ejected into the tray 71. This purge operation will improve the ejection of ink from a nozzle 108 having a problem in ejection due to clogged ink or thickened ink. The ink having ejected into the tray 71 moves toward left of FIG. 6A along the bottom surface of the tray 71, and flows into the waste-ink receiving tray 77. Then, the purged ink is discharged from an ink discharging hole 77*a* of the waste-ink receiving tray 77. However, part of the ink will remain on the ink ejecting surface 3*a* in the form of ink droplet.

Next, the frame moving structure 51 moves the inkjet heads 2 slightly downward. More specifically, when the tray 71 moves from the maintenance position to the standby position, the inkjet head 2 is moved to a position so that: (i) the leading edge of the wiper 72 is able to abut the under surface of each of the ink ejecting surface 3*a* and the under surface of the frame 4; and (ii) a space of 0.5 mm is formed between the ink ejecting surface 3*a* and the upper end of the thin plates 73*a* of the ink receiving member 73. Then, as shown in FIG. 6B, a wiping operation is performed by operating the horizontal movement structure 91 to move the tray 71 to the left: i.e., from the maintenance position to the standby position.

At this point, the upper end of the wiper 72 is located above the under surface of the frame 4. Therefore, the wiper 72 is bent, while it contacts the under surface of the frame 4 and the ink ejecting surface 3*a*. That way the wiper 72 wipes off the ink adhered onto the ink ejecting surface 3*a* through the purge operation. Meanwhile, the upper end of the thin plates 73*a* of the ink receiving member 73 are located nearby the ink ejecting surface 3*a*, but is apart therefrom by a predetermined minute distance. Thus, relatively large ink droplets amongst those on the ink ejecting surface 3*a* are removed by the capillary phenomenon taking place amongst the thin plates 73*a* of the ink receiving member 73.

Thus, there is completed the maintenance operation in which an inkjet head 2 having a problem in its ink ejection is recovered through the purge operation, and the ink adhered onto the ink ejecting surface after the purge operation is wiped off. Note that the under surface of the frame 4 is substantially flush with the ink ejecting surface 3*a*. Therefore, the wiper 72 also wipes the under surface of the frame 4, when the tray 71 moves back to the standby position.

Next, the following describes a capping operation in which a the entire ink ejecting surface 3*a* is covered with the corresponding cap 76. This capping operation is performed during a halt period. The halt period herein refers to a long period during which the printer 1 performs no printing onto a sheet. In this case, too, the frame moving structure 51 moves the inkjet heads 2 from the printing position to the isolation position, as is already mentioned. Then, the trays 71 and 75, while being connected to each other by means of the hooking members 83, are moved by the horizontal movement structure 91 to the maintenance position. At this point, as shown in FIG. 7A, the plate-like member 76*b* of each of the caps 76 is positioned so as to face the entire corresponding ink ejecting surface 3*a*, and each of the circular protrusions 76*a* is positioned so as to face the outer circumferential wall 104*a* of the corresponding passage unit 104.

Next, as shown in FIG. 7B, the frame moving structure 51 moves each of the inkjet heads 2 slightly downward, so as to have the leading edge of each of the circular protrusions 76 abut against the outer circumferential wall 104*a* of the corresponding passage unit 104. Specifically, as shown in FIG. 8, the leading edge of the circular protrusion 76*a* abuts the edge 129*a* of the cover plate 129 and the edge 128*a* of the manifold plate 128, so as to enclose the entire nozzle plate 130 in the recessed portion 78 formed by the circular protrusion 76*a*: i.e., within the space surrounded by the inner surface of the circular protrusion 76*a* and the top surface of the plate-like member 76*b*.

As described, by having the circular protrusion 76*a* abut against the two edges 128*a* and 129*a*, the air tightness of the sealed space surrounded by the cap 76 and the passage unit 104 is improved. Additionally, the circular protrusion 76*a* abuts against the edges 128*a* and 129*a* respectively formed on the manifold plate 128 and the cover plate 129. This improves the air tightness of the sealed space more. Thus, the plurality of the nozzles 108 formed on the nozzle plate 130 are covered by the highly airtight sealed space. This prevents the ink inside the nozzles 108 from being dried off.

Thus, with the inkjet printer 1 of the present embodiment, it is possible to form a sealed space for covering the plurality of the nozzles 108 on the nozzle plate 130, while preventing the circular protrusion 76*a* of the cap 76 from abutting the ink ejecting surface 3*a*. A foreign substance adhered onto the circular protrusion is therefore restrained from transferring onto the ejecting surface 3*a*. As a result, the ink ejection from the nozzle 108 is stabilized. Further, each of the caps 76 has the plate-like member 76*b* and the circular protrusion 76*a* protruding from the periphery of the plate-like member 76*b*. Therefore, it is further advantageous in that a sealed space can be created even with the simple structure of the cap 76, by having the circular protrusion 76*a* abut against the outer circumferential wall 104*a*.

Figure 9:
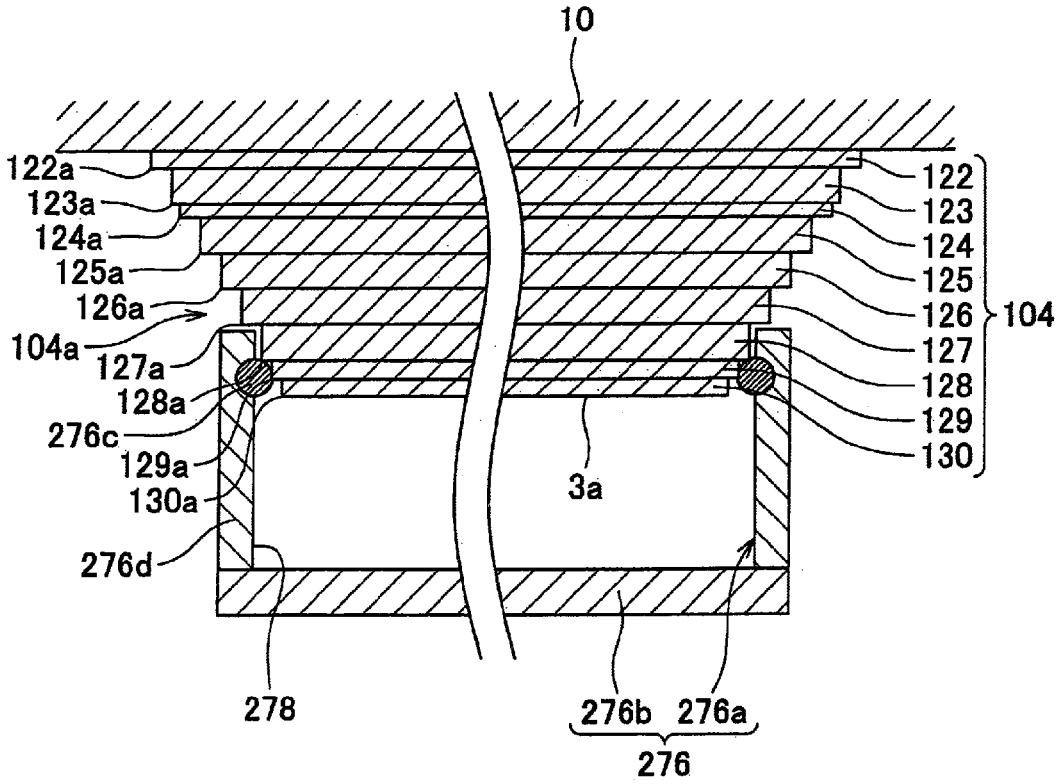
FIG. 9 is a partial cross sectional view showing a situation where the cap of an inkjet printer of Embodiment 2 according to the present invention abuts the outer circumferential wall of the passage unit.

Next, the following describes with reference to FIG. 9, an inkjet printer of Embodiment 2 according to the present invention. FIG. 9 is a partial cross sectional view showing a situation where one of caps of the inkjet printer of Embodiment 2 abuts an outer circumferential wall 104*a* of the corresponding one of passage units 104. The inkjet printer of the present embodiment is the same as that of the foregoing Embodiment 1, except in that the structure of each cap is slightly different from that described in Embodiment 1. Note that members identical to those described in the foregoing Embodiment 1 are given the same symbols and the explanations therefor are omitted here.

As shown in FIG. 9, each cap 276 includes: a plate-like member 276*b* which is one size larger than a nozzle plate 130, and whose shape is rectangular plane; and a circular protrusion 276*a* protruding upward from the periphery of the plate-like member 276*b*. The circular protrusion 276 includes: a base part 276*d* extended upward from the plate-like member 276; and an O-ring 276*c* fixed nearby the upper end of the inner circumference of the base part 276*d*. In the present embodiment, the base part 276*d* is made of resin, and the O-ring 276*c* is made of an elastic material such as rubber.

In the present embodiment, the O-ring 276*c* is fixed onto the base part 276*d*; however, the O-ring 276*c* may be attachable/detachable to/from the base part 276*d*, in which case the O-ring is replaceable with another one when the elasticity of the O-ring varies with elapse of time. This allows easy recovery of the capping function.

As in the foregoing embodiment, during a halt period, the plate-like member 276*b* of each cap 276 is positioned so as to face the entire corresponding ink ejecting surface 3*a*, and each of the circular protrusions 276*a* is positioned so as to face the outer circumferential wall 104*a* of the corresponding passage unit 104. Here, the halt period herein refers to a long period during which the printer 1 performs no printing onto a sheet, as is already mentioned in the foregoing Embodiment 1. Then, each of the inkjet heads 2 is moved downward so as to have the O-ring 276*c* of the circular protrusion 276*a* abut the outer circumferential wall 104*a* of the passage unit 104. Specifically, as shown in FIG. 9, the O-ring 276*c* of the circular protrusion 276*a* abuts the edge 129*a* of the cover plate 129 and the edge 128*a* of the manifold plate 128, and the entire nozzle plate 130 is enclosed in the recessed portion 278 formed by the circular protrusion 276*a*.

As described, by having the O-ring 276*c* abut the two edges 128*a* and 129*a*, it is possible to create a sealed space surrounded by the cap 276 and the passage unit 104 while preventing the cap 276 from abutting the ink ejecting surface 3*a*, as is the case of Embodiment 1. Thus, the present embodiment also yields effects similar to those of the foregoing Embodiment 1. Further, since the O-ring 276*c* abuts the two edges 128*a* and 129*a*, the air tightness of the sealed space is improved, and the ink inside the nozzles 108 is effectively kept from drying off. Further, in the circular protrusion 276*a*, the rubber made O-ring 276*c* is fixed onto the resin-made base part 276*d*. Therefore, it is no longer necessary to form the circular protrusion 276*a* itself by using an elastic material such as rubber. Since the circular protrusion 276*a* is more easily manufactured compared to a case of manufacturing the same using an elastic material, it is possible to reduce the production cost. Additionally, the shape of the cap 276 is stabilized by using resin to form the parts other than the O-ring 276*c*, i.e., the base part 276*d*.

Figure 10A:
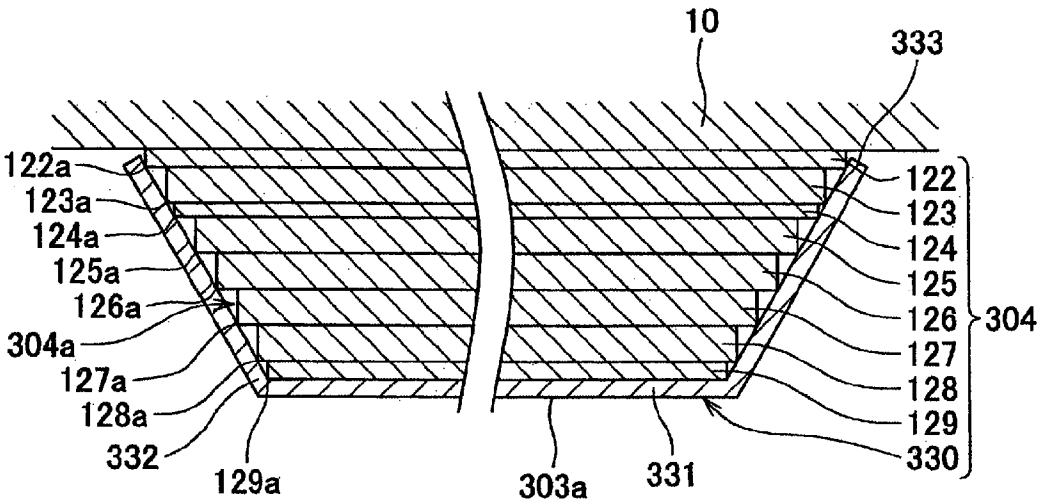
FIG. 10A is a cross sectional view showing a passage unit of an inkjet printer of Embodiment 3, according to the present invention.
Figure 10B:
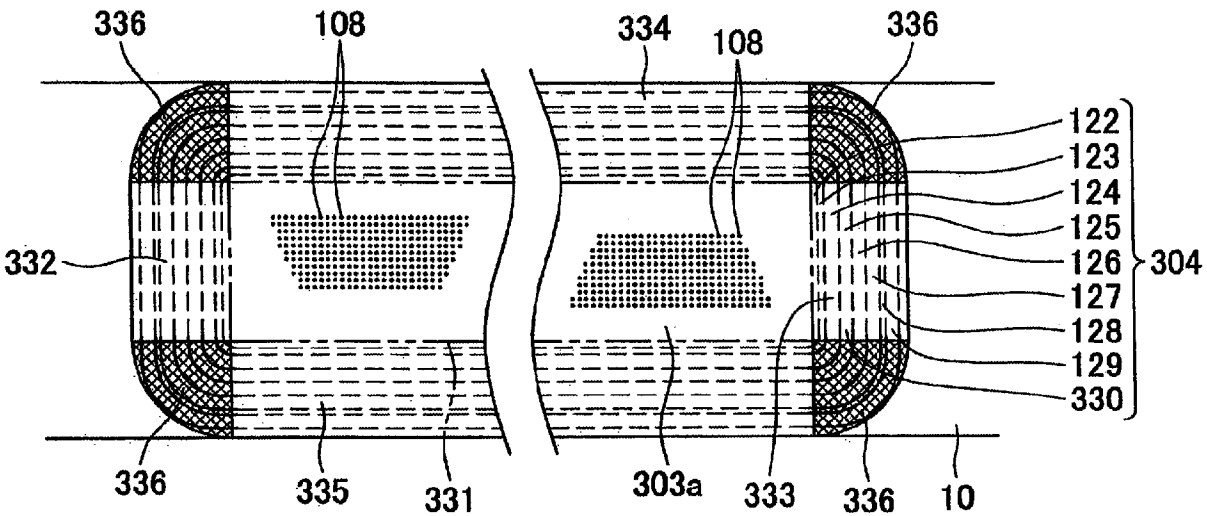
FIG. 10B is a plane view showing the passage unit of FIG. 10A, when viewed from the bottom.
Figure 11:
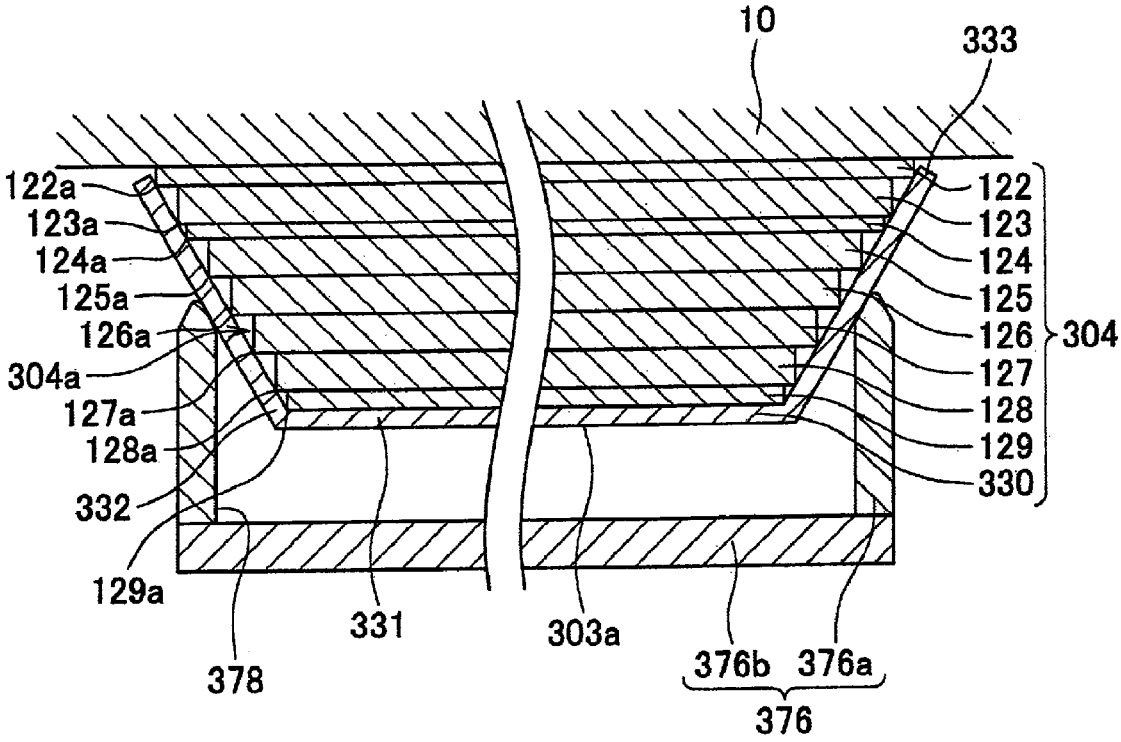
FIG. 11 is a partial cross sectional view showing a situation where a slanted portion of a nozzle plate of the passage unit and the cap, each shown in FIG. 10A, abut each other.

Next, the following describes, with reference to FIGS. 10A and 11, an inkjet printer of Embodiment 3 according to the present invention. FIG. 10A is a cross sectional view showing a passage unit of the inkjet printer of Embodiment 3 according to the present invention. FIG. 10B is a plane view showing the passage unit of FIG. 10A, when viewed from the bottom. FIG. 11 is a cross sectional view showing a situation where one of caps abuts a slanted portion of the nozzle plate of the passage unit. The inkjet printer of the present embodiment is the same as that of the foregoing Embodiment 1, except in that the structure of the passage unit 304 is slightly different from the passage unit 104 of Embodiment 1, and that each of the caps 376 is slightly larger than each of the caps 76 described in Embodiment 1. Note that members which are identical to those described in the foregoing Embodiment 1 are given the same symbols and the explanations therefor are omitted here.

The passage unit 304 of the present embodiment includes: eight plates 122 to 129 which are identical to those of Embodiment 1; and a nozzle plate 330 whose shape slightly differs from that described in Embodiment 1. As shown in FIGS. 10A and 10B, the nozzle plate 330 includes:

a plane portion 331 which has a plane rectangular shape, and which is parallel to the respective under surfaces or top surfaces of the eight plates 122 to 129; and four slanted portions 332 to 335 respectively connected to four edges of the plane portion 331, and which are slanted at an angle with respect to the plane portion 331 so as to face an outer circumferential wall 304*a* formed in a stair-like shape by the eight plates 122 to 129. In FIG. 10B, the plane portion 331 is the rectangular part segmented by the chain double-dashed lines. Here, the plane portion 331 has a plurality of nozzles 108 which penetrates the plane portion 331 in the thickness direction. This under surface of the plane portion 331 serves as the ink ejection surface 303.

As shown in FIG. 10B, slanted portion 332 and 333 are outwardly extended in the length direction of the plane portion 331, from a pair of short edges of the plane portion 331 parallel to each other. Further, the slanted portions 334 and 335 are outwardly extended in the width direction of the plane part 331, from a pair of long edges of the plane portion 331 parallel to each other. Further, the slanted portion 332 to 335 are apart from each other nearby the corners of the plane portion 331. Further, the respective surfaces of the four slanted portions 332 to 335 facing the outer circumferential wall 304*a* abut the edges 122*a* to 129*a* of the eight plates 122 to 129.

By having the slanted portions 332 to 335 abut the edges 122*a* to 129*a*, the force applied when the circular protrusion 376*a* abuts the slanted portions 332 to 335 is absorbed by the edges 122*a* to 129*a*. Therefore, the slanted portion 332 to 335 are barely bent. This improves the air tightness of the sealed space surrounded by the passage unit 304 and the cap 376. Further, between the four slanted portion 332 to 335, sealing materials 336 are disposed. Accordingly, when the circular protrusion 376 abuts the slanted portions 332 to 335, it is less likely that a space is formed in portions nearby the corners of the plane portion 331 where the slanted portions 332 to 335 are separated. This further improves the air tightness of the sealed space.

The structure of each of the caps 376 having the circular protrusion 376*a* and the plate-like member 376*b* is the same as that of the cap 76 of Embodiment 1, except in that the size of the cap 376 is slightly larger.

In the present embodiment, during a halt period, the plate-like member 376*b* of each of the caps 376 is positioned so as to face the entire corresponding ink ejection surface 303*a*, and each of the circular protrusions 376*a* is positioned so as to face the slanted portions 332 to 335 of the corresponding nozzle plate 330. Then, each of the inkjet heads 2 is moved downward so as to cause the leading edge portion of the circular protrusion 376*a* to abut the slanted portions 332 to 335 and the sealing materials 336 of the nozzle plate 330, thereby enclosing the entire ink ejection surface 303*a* within the recessed portion formed by the circular protrusion 376.

Thus, a sealed space for covering the plurality of nozzles 108 formed on the nozzle plate 330 is formed while keeping the circular protrusion 376*a* of the cap 376 from abutting the ink ejection surface 303*a*. Thus, effects similar to those of the foregoing Embodiment 1 are acquired.

The foregoing Embodiment 1 dealt with a case where the leading edge portion of each of the circular protrusions 76*a* abuts the two edges 128*a* and 129*a*, and the foregoing Embodiment 2 dealt with a case where the O-ring 276*c* abuts the two edges 128*a* and 129*a*. However, the leading edge or the O-ring 276 may abut only one edge or three or more edges. Further, the leading edge portion of the circular protrusion 76*a* and the O-ring 276*c* may abut the side surfaces of one of the nine plates 122 to 130, and/or abut a peripheral portion of the under surface of these plates. Further, in Embodiment 3, the slanted portions 332 to 335 abut all the edges 122*a* to 129*a*. However, these portions may abut only one edge or no edges.

Further, in Embodiment 3, the outer circumferential wall 304*a* of each of the passage units 304 is formed in a stair-like shape. However, the outer circumferential wall may be extended in a direction perpendicular to the ink ejection surface 303*a*. In this case, to avoid a loss in the air tightness between the slanted portions 332 to 335, it is preferable that at least one plate abutting the circular protrusion 376*a* have the above-described stair-like outer circumferential wall.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording device, comprising:

an inkjet head which includes a passage unit formed by a lamination of a plurality of plates and a nozzle plate having a plurality of nozzles, and laminated so that the nozzle plate is positioned outermost of the lamination; and a cap which covers the plurality of nozzles, and includes a circular protrusion forming a recessed portion having an opening broader than the nozzle plate, wherein:

amongst the plurality of plates and the nozzle plate, a plate positioned farther from the nozzle plate has a larger plane shape than a plate closer to the nozzle plate so that the passage unit has, around the entire circumference thereof, a stair-like shaped outer circumferential wall; and when the cap covers the plurality of nozzles, the circular protrusion abuts the outer circumferential wall of the passage unit so as to enclose the nozzle plate within the recessed portion.

2. The inkjet recording device according to claim 1, wherein: the circular protrusion abuts two portions of the outer circumferential wall each of which portions is apart from the nozzle plate in a direction away from the nozzle plate.

3. The inkjet recording device according to claim 2, wherein: the two portions are respectively edges of two plates in the lamination except the nozzle plate, each of which edges is formed at a boundary between a surface facing the nozzle plate and a side surface of one plate in the two plates.

4. The inkjet recording device according to claim 1, wherein: when the cap covers the plurality of the nozzles, a leading edge portion of the circular protrusion abuts the outer circumferential wall of the passage unit.

5. The inkjet recording device according to claim 1, wherein:

the circular protrusion has an O-ring around the inner circumference thereof; and when the cap covers the plurality of the nozzles, the O-ring abuts the outer circumferential wall of the passage unit.

6. An inkjet recording device, comprising:

an inkjet head which includes a passage unit formed by a lamination of a plurality of plates and a nozzle plate having an ink ejection surface which a plurality of nozzles are positioned, and laminated so that the ink ejection surface of the nozzle plate is positioned outermost of the lamination; and a cap which covers the plurality of nozzles, and includes a circular protrusion forming a recessed portion having an opening broader than the ink ejection surface, wherein:

amongst the plurality of plates, a plate positioned farther from the nozzle plate has a larger plane shape than a plate closer to the nozzle plate so that the lamination of the plurality of plates has a stair-like shaped outer circumferential wall around the entire circumference thereof;

the nozzle plate has slanted portions each of which is continuous from the ink ejection surface, and which is tilted relative to the ink ejection surface so as to face the plurality of plates;

each of the slanted portions abuts at least one of edges of the plurality of plates, each of the abutted edges is formed at a boundary between a surface facing the nozzle plate and a side surface of one of the plurality of plates; and when the cap covers the plurality of nozzles, the circular protrusion abuts the slanted portions.

7. The inkjet recording device according to claim 6, wherein:

the ink ejection surface has a quadrangular shape; and the slanted portions are respectively connected to four edges of the ink ejection surface, and are apart from one another nearby corners of the ink ejection surface;

and a sealing material is positioned between each of the slanted portions.

8. The inkjet recording device according to claim 6, wherein: the slanted portions each abuts a plurality of the edges of the plurality of plates, each of which edges is formed at the boundary between the surface facing the nozzle plate and the side surface of the one plate in the plurality of plates.

* * * * *